United States Patent [19]

Granatek et al.

[11] 4,377,420

[45] Mar. 22, 1983

[54] REMOVAL OF CARBONACEOUS MATERIAL FROM GAS TURBINE CAVITIES

[75] Inventors: Bronislaw J. Granatek, Vernon; Lawrence D. Hall, Bristol, both of Conn.

[73] Assignee: United Technologies Corporation, Hartford, Conn.

[21] Appl. No.: 127,604

[22] Filed: Mar. 6, 1980

[51] Int. Cl.[3] ..... B08B 5/00

[52] U.S. Cl. ..... 134/2; 134/20; 134/22.1; 134/30

[58] Field of Search ..... 134/2, 17, 19, 20, 22 R, 134/30, 37, 39

[56] References Cited

U.S. PATENT DOCUMENTS

| | | | |
|---|---|---|---|
| 1,081,950 | 12/1913 | Eller | 134/20 X |
| 2,443,373 | 6/1948 | Borsoff | 134/20 |
| 2,620,286 | 12/1952 | Shaw | 134/20 X |
| 3,532,542 | 10/1970 | Shimizu et al. | 134/20 |
| 4,022,639 | 5/1977 | Ueki | 134/20 X |

*Primary Examiner*—Marc L. Caroff

*Attorney, Agent, or Firm*—C. G. Nessler

[57] ABSTRACT

An improved method of cleaning carbonaceous matter from enclosed cavities in gas turbine engines is comprised of providing inlet and exit gas ports to the cavity, carefully heating the structure having the cavity to above 470° C. and providing air at controlled temperature, flow, and pressure. The temperature, pressure and flow is controlled during the process to induce flow through cavities which are fully blocked initially, and to avoid over pressurization of cavities which are not adapted to sustain substantial pressure.

9 Claims, 3 Drawing Figures

REMOVAL OF CARBONACEOUS MATERIAL FROM GAS TURBINE CAVITIES

DESCRIPTION

Technical Field

This invention relates to cleaning processes for articles having accumulated oil-derived deposits, particularly gas turbine structures and the like.

Background Art

Gas turbine engines and other like devices which use hydrocarbon fuels and various lubricating oils are often times prone to acquiring deposits attributable to contact of such oils with hot surfaces. In certain regions the temperatures are sufficient to cause presumed cracking and thus these deposits are termed "carbonaceous"; but while they are preponderantly carbon containing, other residues are commonly present as well. The deposits can inhibit the proper function of structures by forming a heat conductive path, increasing weight, and impeding cooling air circulations. They tend to be very hard, adhere to metals, and are not dissolvable in common solvents. When somewhat analogous deposits have been found on exposed surfaces such as gas turbine fuel nozzles some in the past have had the practice of placing the articles in furnaces and subjecting them to prolonged heating to thereby remove the deposits by apparent oxidation.

A special problem is presented by cavities which are virtually closed and therefore not accessible. A particular example is the cavity of an intermediate engine case structure, as described in more detail later in this application. For many years, these deposits were removed mechanically with great difficulty. Generally the case had to be partially cut apart to expose and physically remove the deposits. Thereafter, the case was restored by welding. But this operation has been costly and necessitates undesirable welding of relatively large areas which can cause distortion. Further, it has been found extremely difficult to fully remove the hard deposits from small interstices within the cavities. Another option has been replacement by cutting and welding of the whole cavity-containing subassembly. This also incurs high cost and distortion in the restored structure.

Simply heating the structure in air, as with the fuel nozzles, will not be effective since the cavity is substantially sealed. Furthermore, components such as intermediate cases are complex weldments of high precision and cost. Although adapted to use at moderately high temperatures when incorporated in an engine, they cannot alone be heated to high temperatures casually without risk of metallurgical degradation and permanent distortion which make them unserviceable. Thus, there is a need for an improved cleaning process which is effective, relatively simple, and which does not adversely affect the structure.

DISCLOSURE OF INVENTION

An object of the invention is to clean carbonaceous containing matter from closed cavities in structures, without causing distortion or degradation of the structure.

According to the invention, a closed cavity in a structure is provided with ports and is cleaned by causing a reactive gas to flow therethrough while the structure is heated. In the preferred method of cleaning a typical gas turbine intermediate case made of AISI 410 steel, the temperature is held at greater than 470° C., preferably 550° C., and air is caused to flow from a small entrance port to a small exit port both of which are penetrated into the cavity. In this manner, carbonaceous material is removed by gasification, and upon cooling, non-gasifying particulate residue can be physically removed by flushing. At the end of the process, the gas ports are closed, as by welding.

Control of the pressure and flow is especially important to the operation of the invention, to both obtain the desired removal and avoid damage to the structure. In the preferred practice of the invention, means are provided for limiting both the flow and pressure which may be applied to the cavity. This avoids pressure-caused deformation and the undesirable cooling and deformation that excess air flow may cause. Further, the control means allow an initial high pressure to be provided in combination with heating of the structure. This is found uniquely suitable for inducing flow through a fully blocked cavity in which no flow is observed upon initial pressurization at room temperature. As the obstruction is removed, the pressure is automatically dropped and the total air flow is limited. This procedure avoids both sustained and possible deforming pressures and excess air flow which can locally cool the structure and cause deformation.

BEST MODE FOR CARRYING OUT THE INVENTION

The invention is described in terms of its application to a gas turbine intermediate case having a closed cavity comprising an annular space between a diaphragm and attendant heat shield. But, it will be understood that the invention is also applicable to other structures for other machines. The deposits which are sought to be removed in gas turbine case are characterized as mostly carbonaceous deposits. This description includes whatever deposits results from the coking of oils generally in the 320°–450° C. range. While such deposits are taken to be primarily carbon it is probable that certain small amounts of other compounds may be present. It will be seen that the present invention is usable for the removal of any deposits using any gas which reactive with the deposit and benign to the structure.

Figure 1:
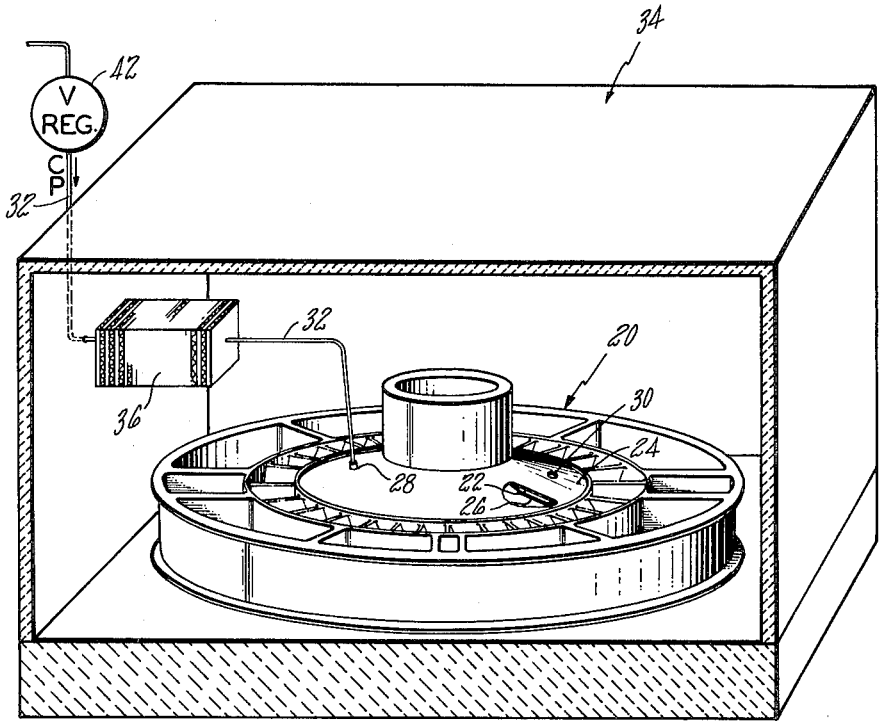
FIG. 1 is a perspective view of a gas turbine intermediate case connected to the apparatus used in the cleaning process.

FIG. 1 shows a partial cross section of a typical gas turbine intermediate case 20. This is a complex precision machined weldment of about 80 cm diameter by 65 cm length, having many cavities and substructures and costing many tens of thousands of dollars. The case is a structural member of a gas turbine engine, being located between the compressor section and the combustor section. Air of the order of 360° C. typically flows through the case, and it is constructed of a heat resisting alloy such as AISI 410 martensitic stainless steel.

Figure 2:
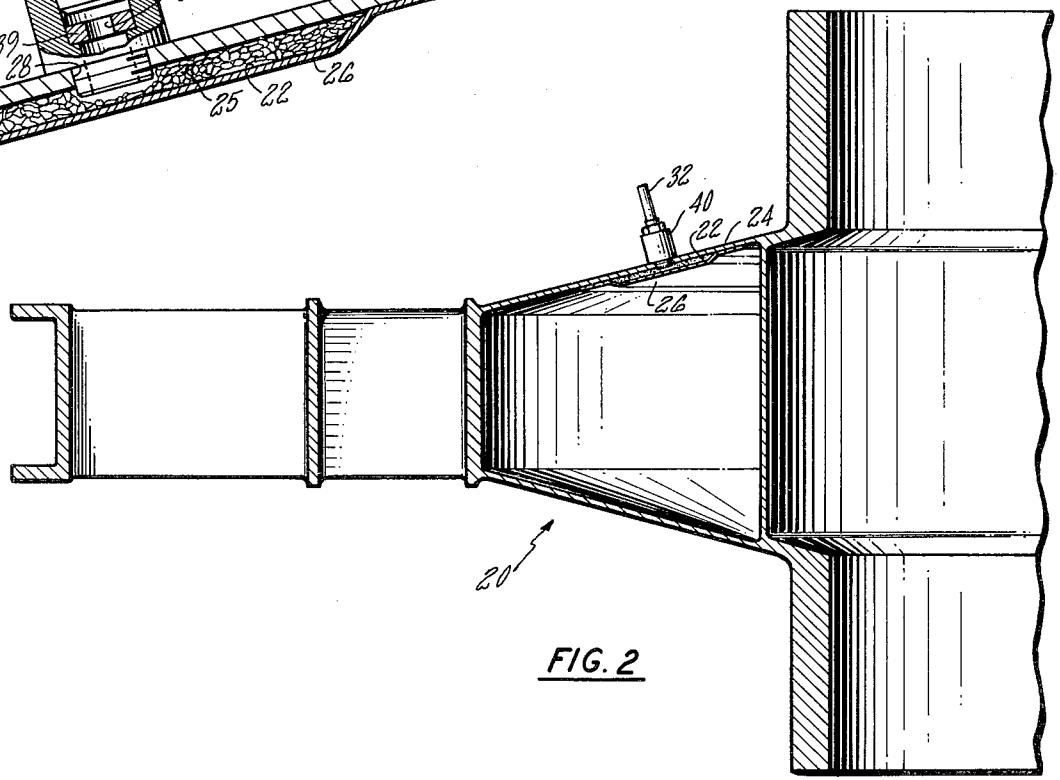
FIG. 2 is a cross section of a segment of the case in FIG. 1 showing in more detail the cavity in which carbonaceous material gets trapped, together with the inlet air line.

FIG. 2 shows a more detailed portion of the intermediate case 20, namely, a cross section of a cavity 22 in which carbonaceous material is known to accumulate during service. The cavity 22 has roughly the configuration of an annular cylinder, being formed by the 1.7 mm thick diaphragm 24 and the 0.05 mm heat shield 26 welded to the diaphragm. By design, the cavity is closed except for a small 1.6 mm diameter air vent in the diaphragm which avoids distortion due to changing internal pressure in use.

Figure 3:
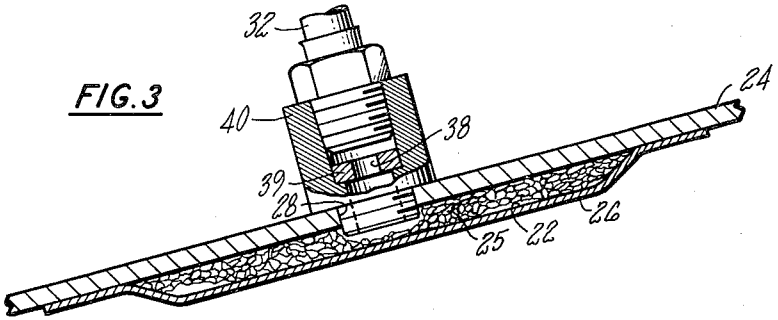
FIG. 3 is a larger scale view of a segment of a case like that in FIG. 2 showing a cavity virtually filled with carbonaceous material with the fitting, orifice, and air line at the inlet port.

Carbonaceous material is presumed to accumulate in the cavity during repetitive start up and shut downs such as characterize the use of a typical aircraft engine. It is surmised that oil vapors are sucked into the cavity through the vent hole and also that higher than normal operating temperatures which cause cracking may follow the shut down of the engine. Regardless of the hypothesis, it is a fact that carbonaceous material 25 is readily observable in the cavity, as illustrated in FIG. 3, by the physical removal of the heat shield. It is found to be hard globular material, often times filling the entire cavity, adhered to itself and the metal cavity walls. It often can be substantially impervious, as is the nature of intentional vapor deposited carbon structures.

The present invention involves controllably providing hot gas to the interior of the cavity to cause oxidation of the deposits. Inasmuch as the primary deposits are comprised of carbon, the products of combustion are gases and will thereby be easily removed.

In practice of the invention, small holes are drilled in the diaphragm, such as are shown in FIG. 1. A gas entry port 28 is placed at a first location on the diaphragm, most preferably that of the above-mentioned vent hole which is thereby enlarged. A gas exit port 30 is placed at a location along the diameter on the opposing side. This will cause the air which is supplied to the entrance port to flow through the greatest length of the cavity (by either or both of the two semi-circular paths) to the exit port. In other structures, the ports will be placed to obtain the best possible flow path through the entire cavity, and it will be evident herein that a multiplicity of ports may be employed to carry out the invention. Compressed air is supplied to the inlet port, such as by means of the inlet gas line 32, and thereupon flows through the cavity unless obstructed as discussed below. The case is then raised to temperature of about 550° C., as by placing it in a furnace 34 shown in FIG. 2. Preferably the air is preheated by a heat exchanger 36 to avoid cooling and thermal distortion in the inlet port vicinity. It is found that air in combination with a temperature higher than about 470° C. will cause oxidation and removal of the bulk of the deposits as gaseous products such as $CO_2$, CO and the like.

However, in many instances, the cavity is blocked with matter and air does not initially flow through the cavity. Obviously, if flow cannot be induced, then the required oxidation will not take place. Pressure may be increased to provide an impetus but the maximum pressure must be very limited since the rather fragile 0.05 mm thick heat shield cannot sustain pressure and is especially weak at the 550° C. range temperature necessary for efficient reaction of carbonaceous matter. A further constraint is embodied in the temperature and heating schedule. From an aircraft safety policy standpoint, as well as metallurgically, it is highly desirable to stay within the constraints of proven thermal cycles for the structure. Thus, we use the following schedule for AISI 410 steel structures:

Place part in cold furnace
315° C. for 30 min
425° C. for 30 min
550° C. for 120 min
furnace cool at no more than about 200° C./hr.

Of course, in other instances the heating schedule may be varied. Generally, it is necessary that the temperature be greater than about 470° C. to cause oxidation in a reasonable number of hours. To induce flow in a cavity found initially blocked to room temperature air, we have discovered as effective the combination of providing air at modest pressure and raising the temperature of the structure and the cavity. Neither parameter applied independently provides the desired effect. We surmise our combination's effectiveness may be attributable to the thermal expansion of the structure, in combination with the elastic deflection and expansion of the cavity provided by the pressure on the heat shield and diaphragm. Inspection of partially cleaned structures has showed us that internal surface gas channels appear to be the initial mode of removal in the cavity.

We have cleaned the intermediate case described above which has an annular cavity of about 28 cm ID by 42 cm OD by 0.2 cm length. Experiments show a pressure which will induce initial flow and remove matter from a filled cavity in the desired time is between about 35 and 50 kPa (5–7 psig). This pressure has been found to be within the capability of the cavity-defining structure to resist without damage. Of course, oxygen or other matter may be added to the air to enhance the removal of material but we have on the whole found air effective and cheap.

As stated, it is typical to have no flow or very low flow initially. But as flow is induced and the obstruction is removed by the practices herein, the resistance in the cavity to flow decreases. Thus, if constant pressure is supplied through the inlet port to the cavity, the steady state flow will substantially increase to a high valve. Too great a flow can result in the air being too cool at the entrance port, in excess demand on the heat exchanger if used, or in sustained pressure being applied to the cavity owing to flow restriction and pressure drop at the outlet port.

Accordingly, we devised a system for modulating the air flow and pressure. As shown in the Figures, an orifice 38 is provided in an orifice plate 39 in a fitting 40 which is placed preferably at the entrance port or elsewhere in the inlet line 32. This in combination with a settable constant inlet line pressure, which is controlled such as by a regulator 42, limits the maximum steady state flow; as an increasing pressure drop is caused at the orifice with increase in through-flow. On the other hand, when there is no flow, the full pressure in the regulator controlled part of the inlet line is applied to the cavity. Thus, it can be generally stated that the combination of apparatus stated above provides to the cavity: a predetermined maximum high pressure initially when flow is zero or very low; a low cavity pressure subsequently when flow is higher; a maximum steady state flow rate; and a maximum transient pressure under any flow condition.

During the furnace cooling cycle, the air may be terminated as desired. After removal of the structure from the furnace, further operations will ordinarily be performed. It is highly desirable to perform a further step of removing a slight powdery residue which may be found in the cavity after the furnace treatment. This is thought to be other material, such as salts from the environment, cleaning compounds, ash from the oil, and like matter which has intruded into the cavity and has been freed by the foregoing steps. The entrance and exit gas ports are well suited to allowing a flushing action using liquids to physically remove matter. Water, chlorinated hydrocarbons, and other solvents are suited to the task. When all cleaning operations have been completed and inspection is satisfactory, the port holes may be conveniently closed, as by GTA welding, as necessary the vent hole restored.

Although this invention has been shown and described with respect to a preferred embodiment thereof, it should be understood by those skilled in the art that various changes and omissions in the form and detail thereof may be made therein without departing from the spirit and scope of the invention.

We claim:

1. In the cleaning of a gas turbine engine structure having a substantially closed cavity containing carbonaceous matter and other residue, the improvement comprising:

providing at least one gas entrance port and at least one gas exit port, the ports being located to allow gas to flow through the length of the cavity;

heating the structure to a temperature sufficient to cause the carbonaceous material to oxidize at a substantial rate but insufficient to cause metallurgical or deformation damage to the structure;

supplying air in controlled quantity and pressure to the gas entrance port to cause the air to flow through the length of the cavity to the gas exit port; the quantity being sufficient to oxidize the carbonaceous material upon becoming heated to about the temperature of the structure, but insufficient to substantially cool the structure; and the air having a pressure sufficient to produce the desired steady state flow through the cavity containing the carbonaceous matter, but insufficient to cause permanent distortion of the structure if flow in the cavity is blocked;

terminating the supply of air; cooling the structure; and, closing the entrance and exit ports.

2. The method of claim 1 further comprising heating the air to about the temperature of the structure prior to delivering the air to the gas entrance port, to avoid cooling and thermal distortion of the structure at higher steady state flow rates.

3. The method of claim 1 further comprising the step of flushing of the cavity with liquids, such as water, oils, and chlorinated hydrocarbons, to remove other film and particulate residue such as salts and ash deposits, the step being performed after cooling and before closing of the ports.

4. The method of claim 1 which further comprises modulating the air flow and pressure in the cavity during the step of supplying air to avoid excess pressure and distortion of the structure when the cavity is blocked and to avoid excess flow when the cavity is essentially free of blockage.

5. The method of claim 4 wherein the modulating comprises providing to a cavity having resistance to flow due to blockage by the carbonaceous matter, a predetermined maximum high pressure initially when flow is low, a lower pressure subsequently when the cavity is less blocked and flow is higher, and a predetermined maximum steady state flow rate.

6. The method of claim 4 wherein the modulating is accomplished by means of a pressure controlled gas inlet line and an orifice plate at the entrance port.

7. The method of claim 1 wherein the closed cavity is formed by a heat shield and a diaphragm in an annular-shaped intermediate case of a gas turbine engine, the cavity having a vent hole, comprising:

(a) enlarging the vent hole to provide an entrance port to the cavity;

(b) making an exit port from the cavity about 180° around the circumference of the case from the entrance port;

(c) providing air to the entrance port at a pressure of at least 35–50 kPa;

(d) controlling and modulating the pressure and flow of air during the time of cleaning;

(e) heating the case slowly to about 550° C. and heating the pressurized air provided to the entrance port to 550° C., said air being of sufficient pressure in combination with heating of the case to overcome any initial impedance to flow caused by removable matter in the cavity and to allow air flow therethrough and oxidation of matter therein;

(f) continuing the heating for time sufficient to remove all carbonaceous matter; and, (g) then cooling the case slowly to avoid distortion.

8. The method of claim 7 further comprising flushing the cavity after cooling using liquid, to remove residue freed from entrapment but not removed by the prior steps.

9. The method of claim 1 which comprises, providing air at a pressure of at least 35 kPa and heating the structure to at least 470° C. to thereby induce the gas flow therethrough and carry the carbonaceous matter away as gaseous products of reaction.

* * * * *